US006179499B1

(12) United States Patent
Beretta et al.

(10) Patent No.: US 6,179,499 B1
(45) Date of Patent: Jan. 30, 2001

(54) AUXILIARY PRINT MEDIA TRAY FOR PRINTER

(75) Inventors: Robert K Beretta, Cupertino; Kevin L Campbell, Compton, both of CA (US); Paul W Martin, Loveland, CO (US); Raymond C Sherman, St. Camas; Jeffrey G. Bingham, Vancouver, both of WA (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/411,959

(22) Filed: Oct. 4, 1999

(51) Int. Cl.[7] ..... B41J 11/50
(52) U.S. Cl. ..... 400/605; 400/624
(58) Field of Search ..... 400/605, 608.2, 400/607, 607.2, 607.3, 608.1, 624, 625; 271/9.09, 9.05, 9.04, 9.02, 911

(56) References Cited

U.S. PATENT DOCUMENTS 4,017,181 * 4/1977 Komaba et al. ..... 355/72
4,791,457 * 12/1988 Shida ..... 355/3
5,000,596 * 3/1991 Naruki ..... 400/625
5,019,839 * 5/1991 Watanabe et al. ..... 400/624
5,116,034 * 5/1992 Trask et al. ..... 400/607
5,177,544 * 1/1993 Kimura et al. ..... 400/624
5,346,197 * 9/1994 Takano et al. ..... 271/9
5,595,380 * 1/1997 McCue ..... 271/9.09
5,730,537 3/1998 Kelly ..... 400/625
5,746,528 5/1998 Mayer et al. ..... 400/625
5,772,343 6/1998 Beretta et al. ..... 400/624
5,957,447 * 9/1999 Sekine ..... 271/9.09

* cited by examiner

*Primary Examiner*—John S. Hilten
*Assistant Examiner*—Anthony H. Nguyen

(57) ABSTRACT

An auxiliary print media tray or cartridge forms part of a print media handling system that provides for holding two discrete supplies of print media in a manner that permits the user to select printing media from one supply or another, without the need for first emptying either of the supplies. The print media is oriented in a manner such that both supplies engage a common media feed mechanism, such as pick and feed rollers. As a result, a printer that employs two discrete media supplies is provided without the increased manufacturing cost or size that would otherwise be required if duplicate pick and feed rollers (or related components) were employed. One embodiment of the present invention is particularly adapted for holding in an auxiliary tray a supply of relatively small print media, such as photo-type paper that is popular as a medium upon which high-quality digital images may be printed.

10 Claims, 7 Drawing Sheets

AUXILIARY PRINT MEDIA TRAY FOR PRINTER

TECHNICAL FIELD

This invention relates generally to a system for handling print media in a printer, and more particularly to an auxiliary tray that enables the system to efficiently support and use a selected one of two discrete supplies of print media that are stored in a printer.

BACKGROUND AND SUMMARY OF THE INVENTION

Printers have trays or drawers that hold a supply of print media, such as paper, in a location where the paper can be brought into engagement with a printer feed mechanism. The feed mechanism contacts the top sheet of the paper supply and advances that sheet into the printer. These feed mechanisms are often referred to as "pick and feed" rollers. From the pick and feed roller, the media sheet is moved into a print zone where an image or text is printed on the sheet.

The supply trays (also known as "input" trays) normally accommodate different sizes of print media. To this end, adjustable guides are built into the input trays to ensure that whatever size paper is provided, it is advanced uniformly (that is, without undesirable skewing) into the printer.

With input trays that are adaptable to handle various sizes of paper, the user is required to remove the existing supply of paper from the tray before adding the different-sized media. This slows the printing operation and, because of the effort required to swap media sizes in this manner, a user may be unwilling to print on different sizes of media.

Some printers are equipped with slots or the like for feeding single sheets of media into a feed mechanism without the need for removing the input tray. This approach, however, does not provide a means for storing in the printer an alternate supply of media that can be selectively fed to a common feed mechanism.

Some printers are provided with more than one input tray, and this arrangement greatly reduces the effort needed to switch printing between different sizes of print media. In the past, however, this duplication of input trays has also led to the duplication of many of the mechanisms for delivering the media to the print zone. Conventional printer designs that use more than one input tray require additional sets of pick and feed rollers or the like to direct to one location (the print zone) sheets of media entering the printer from two different locations. Such relatively complicated media handling systems add to the manufacturing cost and, usually, to the size of the printer.

This invention is directed to a print media handling system that holds two discrete supplies of print media in a manner that permits the user to select for printing a sheet of media from one supply or another, without the need for emptying either of the supplies. Moreover, the print media is held and moved in a manner such that both supplies engage a common feed mechanism, such as pick and feed rollers. As a result, a printer that employs two discrete media supplies is provided without the increased manufacturing cost or size that would otherwise be required if duplicate pick and feed rollers (or related components) were employed.

A preferred embodiment of the present invention is particularly adapted for holding in an auxiliary tray a supply of relatively small print media, such as the photo paper (in the range of 10 centimeters by 15 centimeters, for example) that is popular as a medium upon which high-quality digital images may be printed.

The tray is maintained in a retracted position until the user wishes to print on the media that is held in the tray. The tray is then manually moved by fingertip control of the user. This movement places the leading edge of the media into the "pick zone" of the printer, in which zone the pick rollers can contact the media and advance it into the printer. Once that print task is complete, the user, using fingertip control, retracts the tray so that the media it carries is no longer in the pick zone.

Whenever the tray is in the retracted position, print media in the other input tray (hereafter referred to as a drawer) is exposed in the pick zone. Thus, the user need not make any adjustment to this drawer in order to recommence its use after the tray is retracted. The next print command will cause the printer's pick and feed rollers to engage the media in the drawer. One can appreciate, therefore, that the present invention provides the convenience of a two-tray system, without the complexity of a system requiring pick and feed rollers or other feed mechanisms dedicated to each of the drawer and tray.

A number of other inventive aspects are provided. For instance, a movable stop is used to ensure proper loading of media into the auxiliary tray, but without interfering with the removal of the media from the tray by the pick and feed rollers.

Also provided is a sensor for generating a signal when the auxiliary tray is moved toward the position where the media it carries is in the pick zone. Among other things, this signal (which is fed to the printer controller) prevents damage to the printer or media in the event the user attempts to move the tray toward the pick and feed rollers while those rollers are engaging media in the drawer.

Useful mechanisms are also provided for controlling the position of the tray relative to the printer, and for properly locating different sizes of media in the auxiliary tray.

Other advantages and features of the present invention will become clear upon study of the following portion of this specification and the drawings.

DETAILED DESCRIPTION OF PREFERRED EMBODIMENTS

Before turning to the particulars of preferred embodiments, it is noted that the for the purposes of this description the term "print media" is intended to include cut-sheet paper of any weight, photo-grade paper (or "photo media"), transparencies, envelopes, banners, rolled media, etc. Also, although the preferred embodiment of the invention is adapted for a printer, it is contemplated that the present invention is also useable with many other hard copy devices, of ink-jet or laser type, including copiers, facsimile machines, and scanners.

Figure 1:
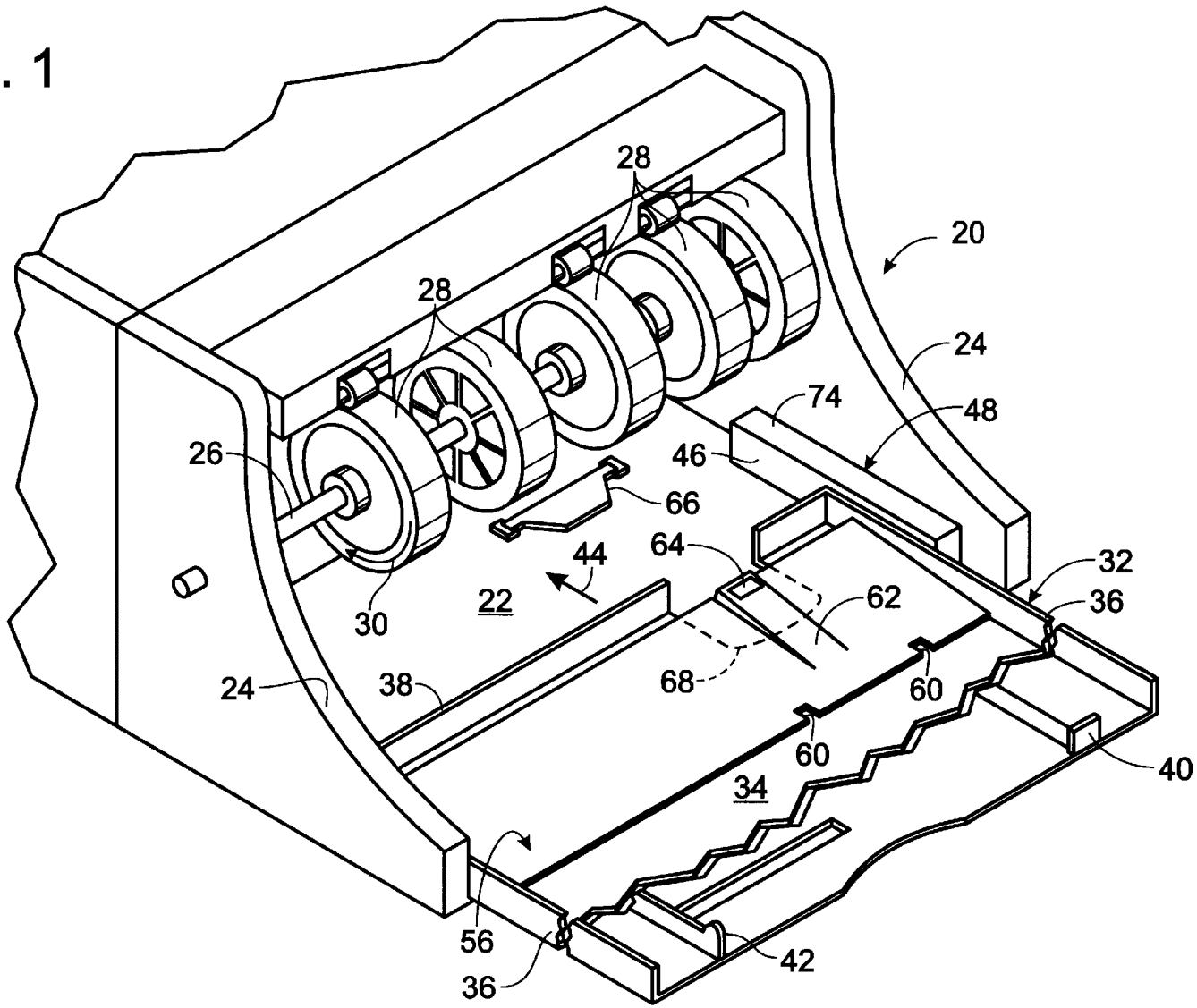
FIG. 1 is a perspective view of a portion of a printer that is adapted to use a media handling system that incorporates the auxiliary tray of the present invention.

In FIG. 1 there is shown a portion of a chassis 20 of a printer with which the present invention may be incorporated. Many of the printer components that are irrelevant to this description are omitted from the figure for clarity of illustration.

The chassis 20 includes a bottom plate 22 and two spaced-apart side walls 24. The side walls 24 support a rotatable shaft 26 that carries a group of pick and feed rollers 28 (hereafter referred to as rollers). The shaft is driven to rotate the rollers 28 in the direction shown by arrow 30 to advance print media, such as paper, one sheet at a time into the printer for receiving the printed image or text.

The rollers 28 have rubber or rubber-like outer surfaces that frictionally engage the top sheet of a supply of paper. A removable drawer 32 that slides into the printer carries one supply of paper, which can be thought of as a main supply.

In a preferred embodiment, the drawer 32 includes a generally flat bottom 34 and opposing side walls 36 that project upwardly therefrom. The inner end of the drawer 32 includes an inner wall 38. The length of the supply of paper carried by the drawer (the paper not shown in FIG. 1) fits between the inner wall 38 and a length guide 40 that projects from the bottom of the drawer and can slide toward and away from the inner wall to accommodate paper of various lengths. The width of the supply of paper carried by the drawer fits between one side wall 36 and a width guide 42 that projects from the bottom of the drawer and can slide toward and away from the side wall to accommodate paper of various widths.

The paper-filled drawer 32 fits snugly between opposing vertical surfaces 46 of a pair of brackets 48 located at the junction of the chassis bottom plate 22 and each chassis side wall 24. Only one bracket 48 is visible in FIG. 1. The drawer 32 is slid into the printer in the direction shown by arrow 44. When the drawer is fully inserted (see FIG. 2) its inner end 37 resides adjacent to the lowermost parts of the rollers 28.

When considering the drawer 32 fully inserted (FIG. 2), the space between the inner end 37 of the drawer and the rollers 28 can be thought of as a pick zone 50. When paper is not being fed into the printer, the distance between the top sheet of paper 52 in the drawer and the nearest part of the rollers 28 represents a dimension of the zone. The arced arrow 54 shows this distance. For clarity, only a single sheet of paper 52 is shown (dashed lines) in FIG. 2. It will be appreciated that the drawer may be initially filled with a stack of paper that fills the tray to the top of the inner wall 38.

The operation for moving or "picking" a top sheet of paper from the drawer occurs when the paper is brought into contact with one or more (at least two) rotating rollers 28. That is, the distance "D" between the roller and paper is eliminated, at least temporarily. In this regard, one of ordinary skill will appreciate that the distance "D" can be eliminated by lowering the rollers 28 to the paper or visa versa. (Alternatively, a selectively drivable roller set could be arranged to permanently rest on the top sheet of paper -yielding upwardly as the tray is removed, refilled, and replaced- and driven only when a paper feed operation is initiated.)

In a preferred embodiment, the distance "D" is eliminated by moving the paper 52 to the rollers 28. To this end, the drawer is equipped with a pressure plate 56 that lines the bottom 34 of the drawer at about the innermost one-third of the drawer. The pressure plate 56 is hinged, such as shown at 60, on the side away from the drawer inner end 37 so that the plate may be rotated, as shown in dashed lines of FIG. 2, toward the rollers 28 to bring the paper 52 into contact with the rotating rollers 28. For illustration, the plate 56 is shown rotated upwardly in FIG. 1.

The pressure plate is formed with a thin ramp 62 that is flush with the surface of the plate 56 near the hinged edge and gradually rises above the surface in the direction toward the inner end 37 of the drawer. The ramp is at its thickest (about 1.5 mm) at the inner end and there underlies a roller 28. In a preferred embodiment a wear surface 64 (FIG. 1), such as cork, is inlaid into the thickest part of the ramp 62. It will be appreciated that the wear surface 64, raised as it is above the remainder of the pressure plate surface, is the only portion of the plate that may be exposed for direct contact with a roller 28 when the plate is rotated toward the rollers.

Figure 2:
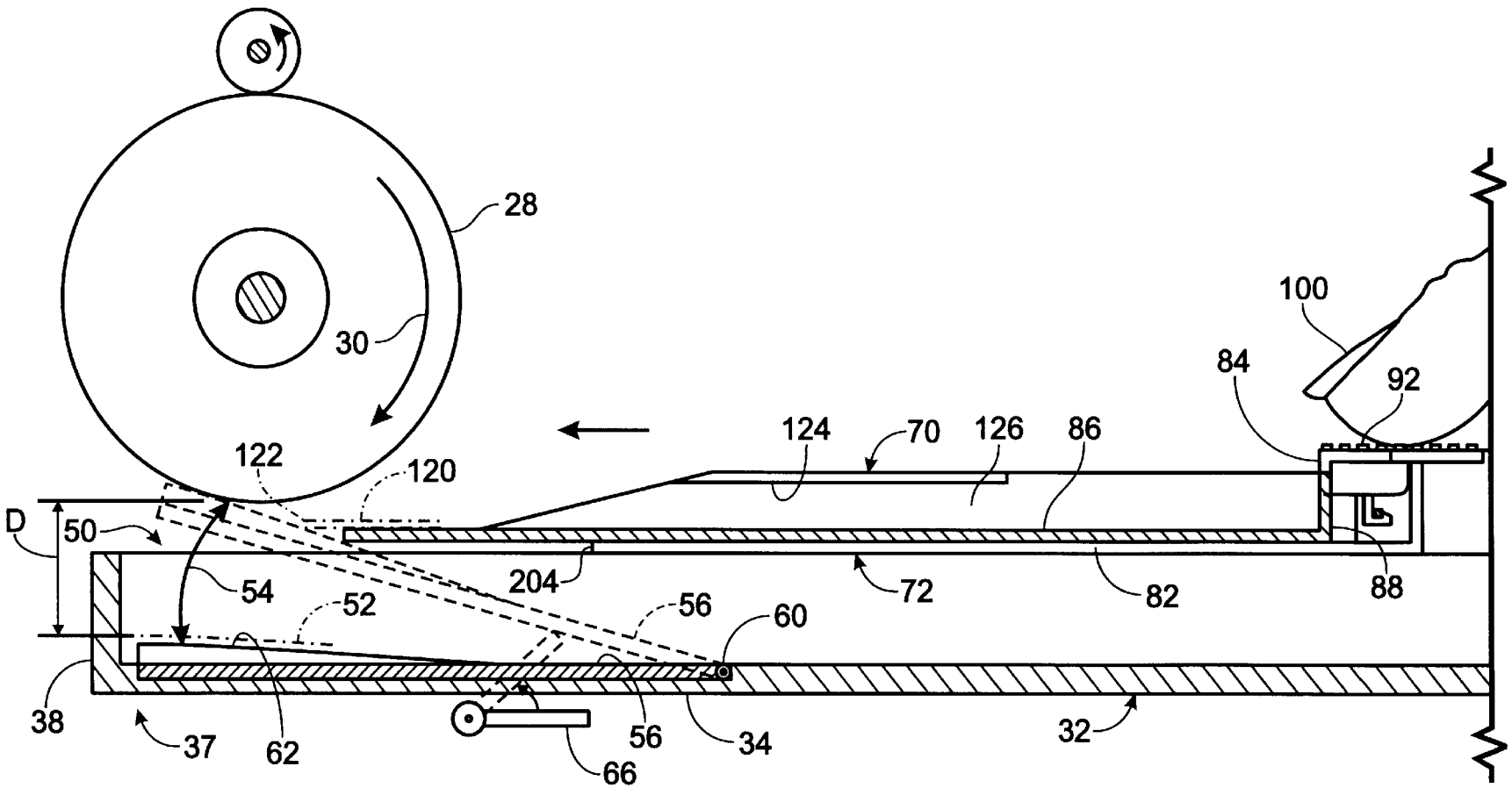
FIG. 2 is a diagram showing in side cross-section a media input drawer and movable auxiliary tray made and used in accordance with the present invention.

Any of a number of mechanisms may be used to rotate or "lift" the pressure plate 56 toward the rollers 28. In the depicted embodiment, a pivotal actuator plate 66 is provided in the bottom plate 22 of the of the printer chassis (FIGS. 1 and 2). The actuator plate 66 is sized to fit through a clearance notch 68 (FIG. 1) formed in the bottom 34 of the drawer, generally underlying the ramp 62. The actuator plate 66 is driven by the printer controller to lift the pressure plate toward the roller as shown in dashed lines of FIG. 2.

As noted, the just-described drawer 32 and associated mechanisms can be considered the main paper supply for the printer. For instance, a user may prefer to hold in the drawer, ready for printing, standard sized paper. In accord with another aspect of this invention, there is also provided an auxiliary tray and associated mechanisms for holding another supply of print media, which supply can be moved by the user into and out of the pick zone so that the auxiliary supply of print media is used in lieu of the main supply. That is, the main supply will be used by default if the auxiliary supply is not moved into the pick zone. This description now turns to the auxiliary tray with initial reference to FIGS. 2–4.

Figure 3:
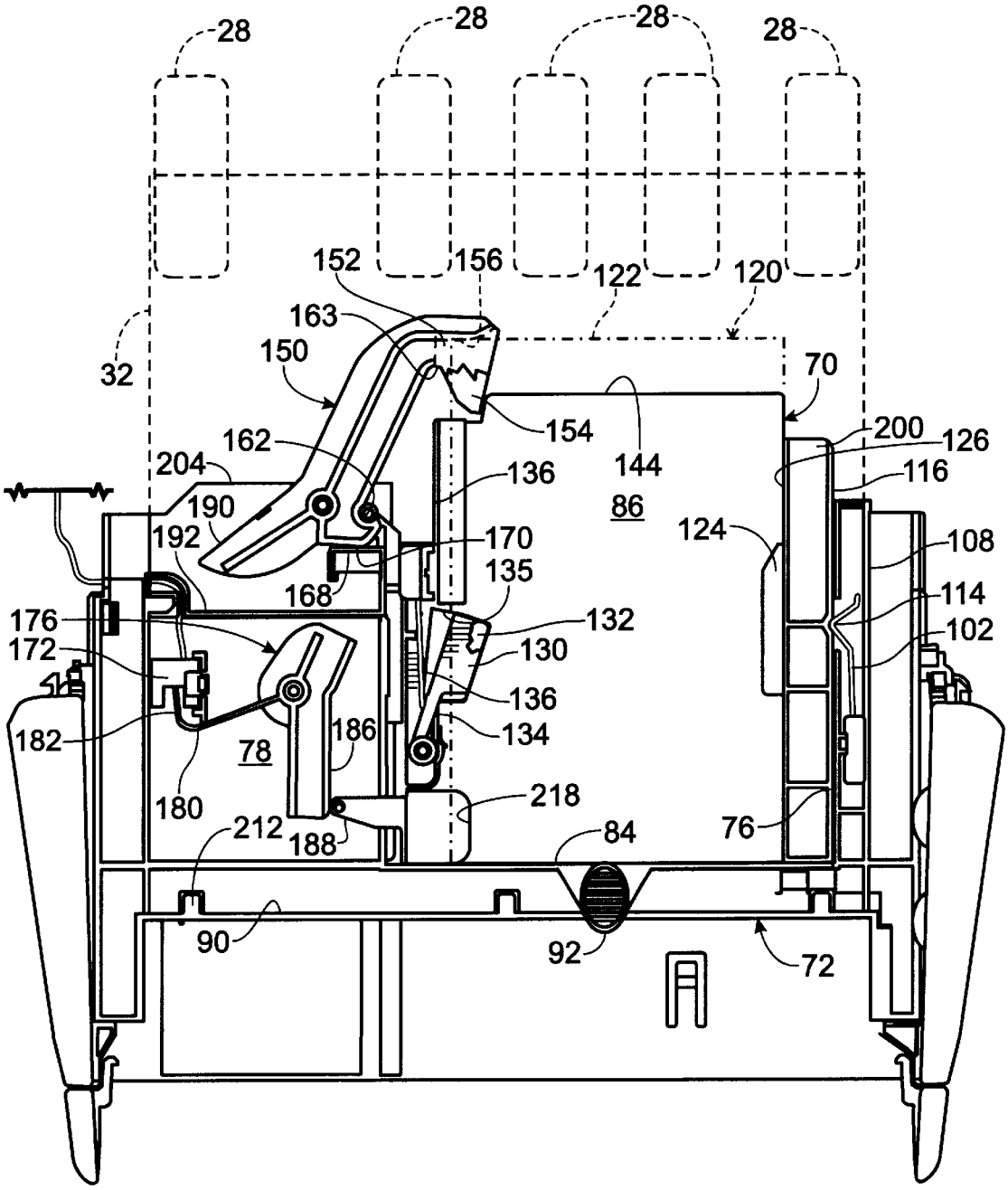
FIG. 3 is a top plan view showing the primary components of the present invention, including a base and slidable auxiliary tray, the tray shown in a retracted position so that media carried by the tray is away from the printer's pick rollers.
Figure 4:
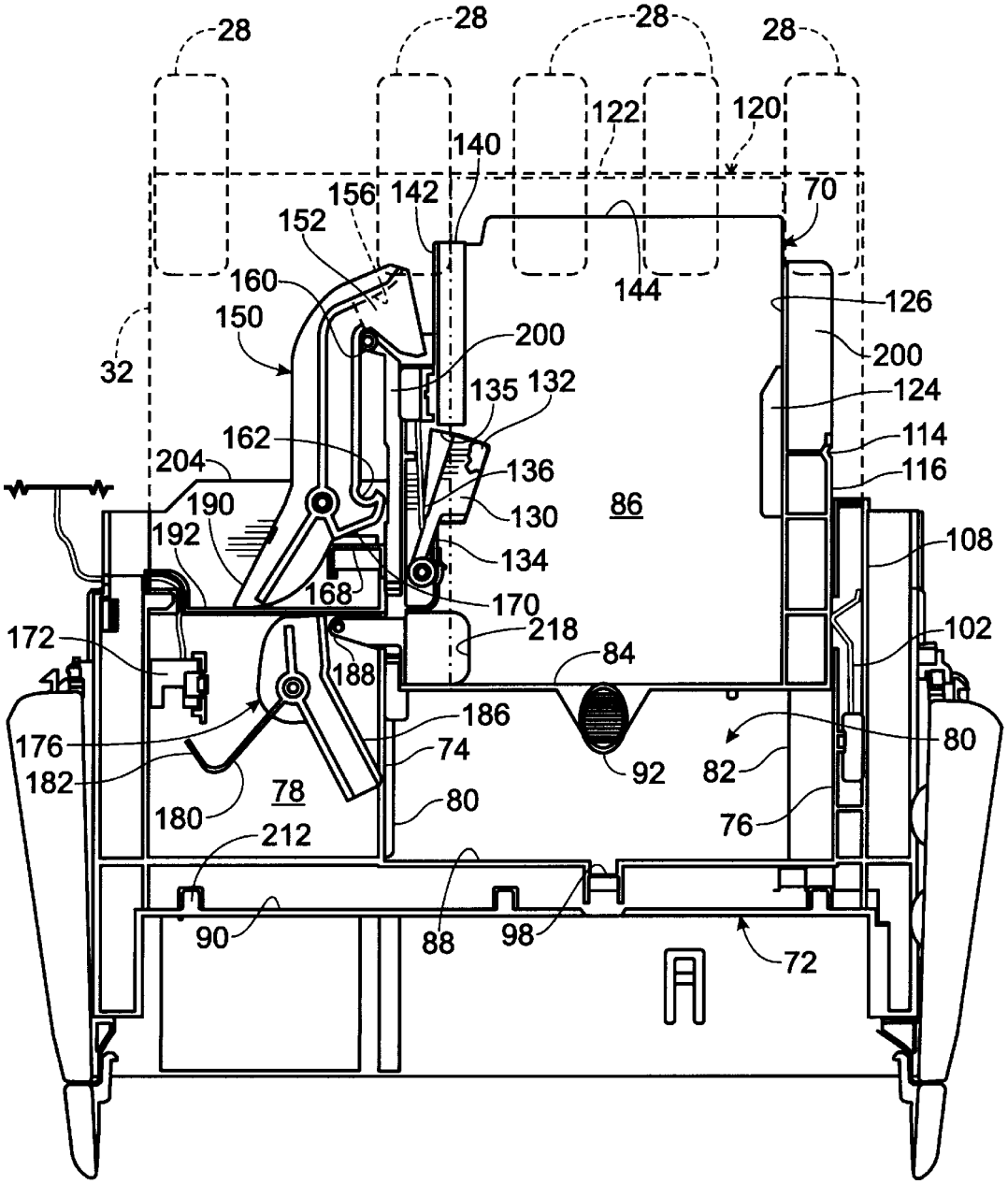
FIG. 4 is a top view, like FIG. 3, but showing the auxiliary tray moved into an extended position so that media carried by the tray is in a position for engagement by the printer's pick rollers.

The auxiliary tray 70 (hereafter, simply "tray") is, like most of the components herein described, formed of injection molded plastic and is generally rectangular in shape as viewed in plan (FIG. 3). (For clarity, only a dashed in portion of the drawer 32 is shown in FIGS. 3 and 4.) The tray is supported for sliding movement by a base 72, which is a generally planar member (except for some upwardly extending walls etc., as described below) that is fastened to and spans between the horizontal surfaces 74 of the above described brackets 48 (FIG. 1). The base 72 holds the tray 70 above the drawer, so that both a media-loaded drawer and a media-loaded tray are simultaneously in the printer, and one need not be swapped for the other.

With reference to FIG. 4, the tray 70 fits between a pair of guide walls 74, 76 that extend upwardly from the flat base plate 78 of the base 72. The tray 70 also extends across a generally rectangular opening 80 in the base plate 78. The underside edges of the tray 70 rest on opposing shelves 80, 82 that project horizontally (i.e., in the plane of FIG. 4) under the sides of the tray. The tray 70 slides along these shelves, as will be discussed more below.

In FIG. 3, the tray 70 is depicted in a retracted position. In this regard, the tray includes an outer wall 84 that projects upwardly from the smooth, flat media-support surface 86 of the tray. That outer wall 84 abuts a forward one 88 of two base walls 88, 90 that extend upwardly from the base plate 78 (FIG. 4).

Figure 6:
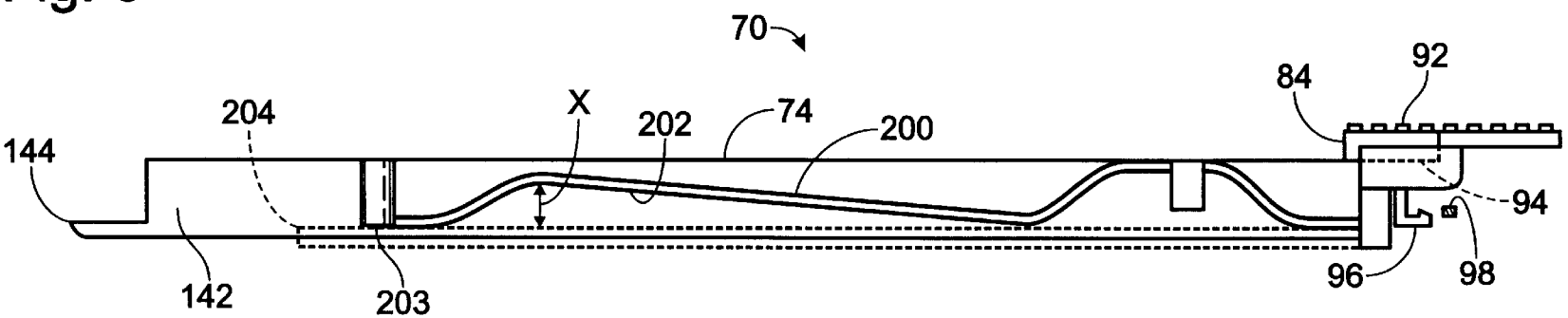
FIG. 6 is an enlarged side view of the auxiliary tray of the present invention.

A finger pad 92 is formed on the tray 70 to extend from the center of the tray outer wall 84. In the retracted position of the tray, the pad extends over the forward base wall 88 and through a notch formed in the rearward base wall 90. As best seen in FIG. 6, the finger pad 92 has a ribbed upper surface. The inner one-half of the ribbed surface is atop a movable button part 94 that extends through a small housing underlying the pad 92 and terminates in a hooked end 96. The button part 94 is spring-biased upwardly. The hooked end 96 of the button part is beveled so that as the tray is moved into the retracted position, the beveled end contacts and slips under a retainer bar 98 that protrudes from the underside of the base plate 78. The button part thereafter snaps back (as a result of the spring bias) to latch onto the retainer bar 98 (FIG. 2).

The user easily moves the tray into the retracted position by single-finger 100 manipulation of the pad 92. To move the tray out of the retracted position, as explained more below, the user depresses the button part 94 and slides the tray forward, releasing pressure on the button once the hooked end 96 has cleared the retainer bar 98.

Figure 5:
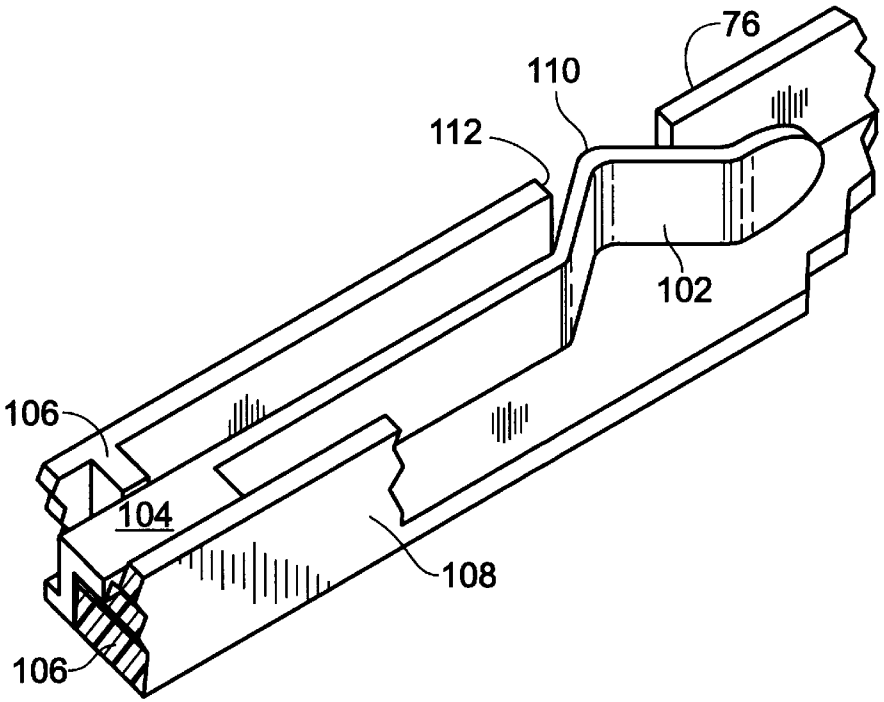
FIG. 5 is a detail view of a spring used to secure the tray in the retracted position.

In addition to the just described latch mechanism, a detent means is provided to resist inadvertent movement of the tray 70 out of the retracted position. This detent means is preferably embodied in a flat, metal spring 102 as shown best in FIG. 3 and the detail of FIG. 5. One end 104 of the spring is made into a reversed "Z" shape and wedged against bosses 106 formed to project into the narrow space between the base guide wall 76 and a parallel support wall 108. The free end of the spring 102 is formed into a "V" shape, the apex 110 of which protrudes through a notch 112 in the guide wall 76.

While the tray is in the retracted position, the apex 110 of the spring fits into a correspondingly shaped groove 114 (see FIGS. 3 and 4) in the outer, right side wall 116 of the tray. The spring yields when the tray is moved out of the retracted position, and the apex 110 rides along the wall 116.

Figure 7:
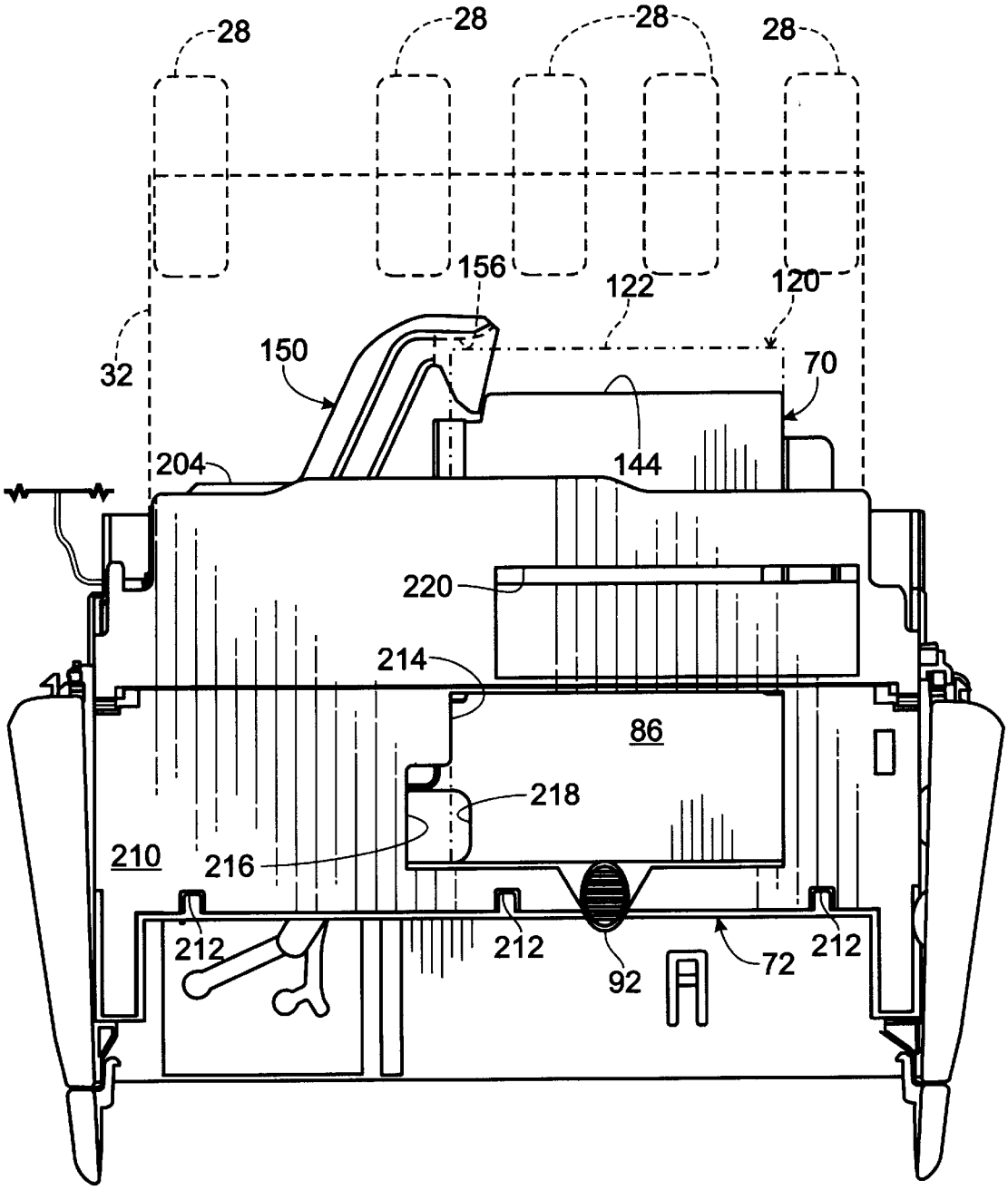
FIG. 7 is a top plan view, like FIG. 3, but showing a cover for the tray in place.

The tray 70 can be loaded with print media while in the retracted position (FIGS. 3 and 7). Media, such as photo-type print media that is sized, for example, to be 15 centimeters long and 10 centimeters wide, is slipped across the media-support surface 86 toward the leading edge 144 of the tray (in the direction from the top to the bottom of FIG. 3). This photo media is shown in the fully loaded position as the dashed lines 120 in FIG. 3.

As the media 120 is advanced to the fully loaded position, its leading edge 122 (here, for simplicity, considering only a single sheet of media 120) passes under a lip 124 that protrudes over the tray surface 86 from the uppermost edge of an inside, right wall 126 of the tray (see FIG. 2). Across from the lip 124, the media 120 also passes between two spaced-apart blades 130, 132 of a cleaver-shaped justification lever 134. The lower blade 132 of the lever is flush with the tray surface 86, fitting into a suitably shaped clearance opening 135 made through that surface. That opening 135 is sized to allow some pivotal movement of the lever as described next.

The justification lever 134 is pivotally mounted to a post that is carried on the tray. The lever is urged by a spring 136 toward the inside right wall 126 of the tray. The spring 136 is carried by the tray and attached thereto (wedged between bosses) in a manner substantially identical to that described with respect to the detent spring 102. The free end of the spring 136 bears against the lever 134. The spring end 136 yields when relatively wide media is slipped between the lever blades 130,132 so that the lever can pivot (counterclockwise in FIG. 3) to accommodate the wider paper yet still press that media against the side of the tray to justify it and to help ensure the media does not move relative to the tray as the tray is extended and retracted.

Another lip 140 (see FIG. 4) is formed in the tray 70 on the left side thereof. That lip 140 protrudes over the tray surface 86 from the uppermost edge of an inside, left side wall 142 that extends upwardly from the tray surface 86 and part way back from the leading edge 144 of the tray. The media 120 slips under this lip 140 when loaded.

As best shown in FIG. 3, a generally "S" shaped stop 150 is provided. The stop is pivotally mounted to the base plate 78 and includes a head that comprises two spaced-apart blades 152,154. The leading edge 122 of the media fits between these blades and abuts a vertical stop wall 156 that is recessed between the blades. This abutment limits the distance that the media 120 may be inserted into the tray 70 while the tray is in the retracted position.

In a preferred embodiment, the distance between the lever blades 130, 134, and the distance between each lip 124,140 and the tray surface 86, and the distance between the stop head blades 154,154, matches the maximum thickness of media to be loaded into the tray 70. In a preferred embodiment, this thickness is about 7 mm, to hold at least 24 sheets of photo media.

When the tray 70 is retracted, a cylindrical post 160, which is formed on the end of an arm that protrudes from the tray side wall 142, nests in a correspondingly shaped curve 162 formed in the stop. The curve 162 and post 160 are configured and arranged to prevent the stop 150 from pivoting (counterclockwise) while the tray is in the retracted position. As a result, the stop wall 156 remains in place to serve as a limit for the loaded media, as described earlier. (As will be seen, the stop moves out of this location when the tray is extended). With the tray in the retracted position, clockwise rotation of the stop 150 out of the stop location shown in FIG. 3 is limited by an abutment 168 that protrudes from the base plate 78 to abut a flattened part 170 on the stop.

A sensor 172 is carried on the base plate 78. A link 176 is rotatably mounted to the base plate 78 near the sensor. The link includes a pair of legs, one of which 180 terminates in a foot 182 (see FIG. 4) that fits into the sensor 172 while the tray is in the retracted position (FIG. 3). Specifically, the preferred sensor 172 is an optical type and the foot 182 fits within a slot between the emitter and detector of that sensor.

The other leg of the link 176 has a contact surface 186 along which rides the rounded end of a sensor arm 188 that is formed with and moves with the tray 70 as the tray is extended and retracted. Referring to FIG. 3, it can be appreciated that in moving out of the retracted position and before reaching the extended position, the tray's sensor arm 188 encounters a part of the contact surface 186 that crosses the linear path traveled by the sensor arm. As a result, the link 176 is rotated counterclockwise by an amount sufficient to pull the foot 182 from between the emitter and detector of the sensor 172. A corresponding output signal (i.e., representing the movement of the tray toward the extended position) is thus provided by the sensor to the printer controller (not shown). It will be appreciated that the sensor output signal is useful, for example, to halt feeding media from the drawer 32 to prevent damage to the printer or media in the event the user attempts to move the tray 70 toward the rollers 28 while those rollers are engaging media in the drawer.

With respect to FIG. 4, as a user wishing to print onto the media carried in the tray 70 moves the tray to the extended position, the above-described post 160 on the tray rides along the facing vertical surface of the stop 150. This has a camming effect on the stop 150 to rotate the stop counterclockwise so that the stop wall 156 in the head of the stop swings away to permit the leading edge 122 of the media to move inwardly, toward the pick zone 50 (FIG. 2). This counterclockwise rotation of the stop 150 is limited by the abutment of a tail 190 on the stop with an intermediate base wall 192.

The cylindrical post 160 of the tray fits against a curve 163 (see FIG. 3) in the stop 150 when the tray is in the extended position (FIG. 4). Inasmuch as the stop, in this position, is limited against further counterclockwise rotation, the fit of the post 160 and curve 163 functions to prevent the extended tray from moving out of its position (that is, preventing skew of the tray relative to the base).

The length of the tray 70 between the outer wall 84 and leading edge 144 is selected to be slightly shorter than the shortest media that is to be carried by the tray. This ensures that, in the extended position, the media, and not the leading edge of the tray, contacts the adjacent rollers 28.

With reference to FIG. 6, the tray includes guide rails 200 having undersides 202 that rest on the above described shelves 80, 82 of the base. The underside 202 appearing in FIG. 6 rests on one shelf 80. A similarly shaped rail underside is provided on the opposite side of the tray (not shown), and the following portion of the description applies to the rails on both sides of the tray.

The rail underside 202 is inclined such that as the tray is slid toward the extended position (moved to the left in FIGS. 2 and 6) the innermost part 203 of the underside 202 will slip off and move slightly beneath the innermost edge 204 of the base plate (where that edge meets the shelf 80) by an distance "X" (FIG. 6) so that the leading edge 144 of the tray, hence, the leading edge of the media 122, is directed toward the wear surface 64 of the ramp 62 to a location such that the leading edge of the media will not contact the rollers 28 unless lifted into such contact by the movement of the above-described pressure plate 56.

So located, the leading edge 144 of the tray 70 is lifted with the pressure plate 56 when paper is to be picked by the rollers 28. In this regard, it is noteworthy that the extended tray 70 is mounted to permit sufficient rotation about its outer wall 84 to permit this lifting motion. This rotation movement of the tray is accomplished in part via sufficient tolerance in the pivotal mounting of the stop 150, which stop is lifted slightly with the tray about an axis generally perpendicular to its pivot axis. In short, the stop pivot connection is loose enough to let the stop move with the tray, rather than impeding that motion.

FIG. 7 shows the present media handling system with a cover 210 that is fixed in place. The cover edge fits under tabs 212 on the base. The cover 210 also includes a number of prongs (not shown) that extend from the underside of the cover to engage mating openings in the base plate 78 to hold the cover in place. The cover conceals the base plate 78 and tray mechanisms but for a window 214 formed in the cover to overlay the outer end of the tray 70 when the tray is retracted. The media supply in the tray may be replenished by inserting the media through the window 214, sliding it into the tray 70.

To facilitate removal of media from the tray, the window 214 is provided with a corner enlargement 216 that aligns with a finger hole 218 made through the surface 86 of the tray. The finger hole enables the user easily to remove the media by lifting the edge or undersides of the media in the tray.

The cover 210 is also provided with an envelope slit 220 to permit a user to manually insert an envelope therethrough so that the edge of the envelop engages the rollers 28.

Figure 8:
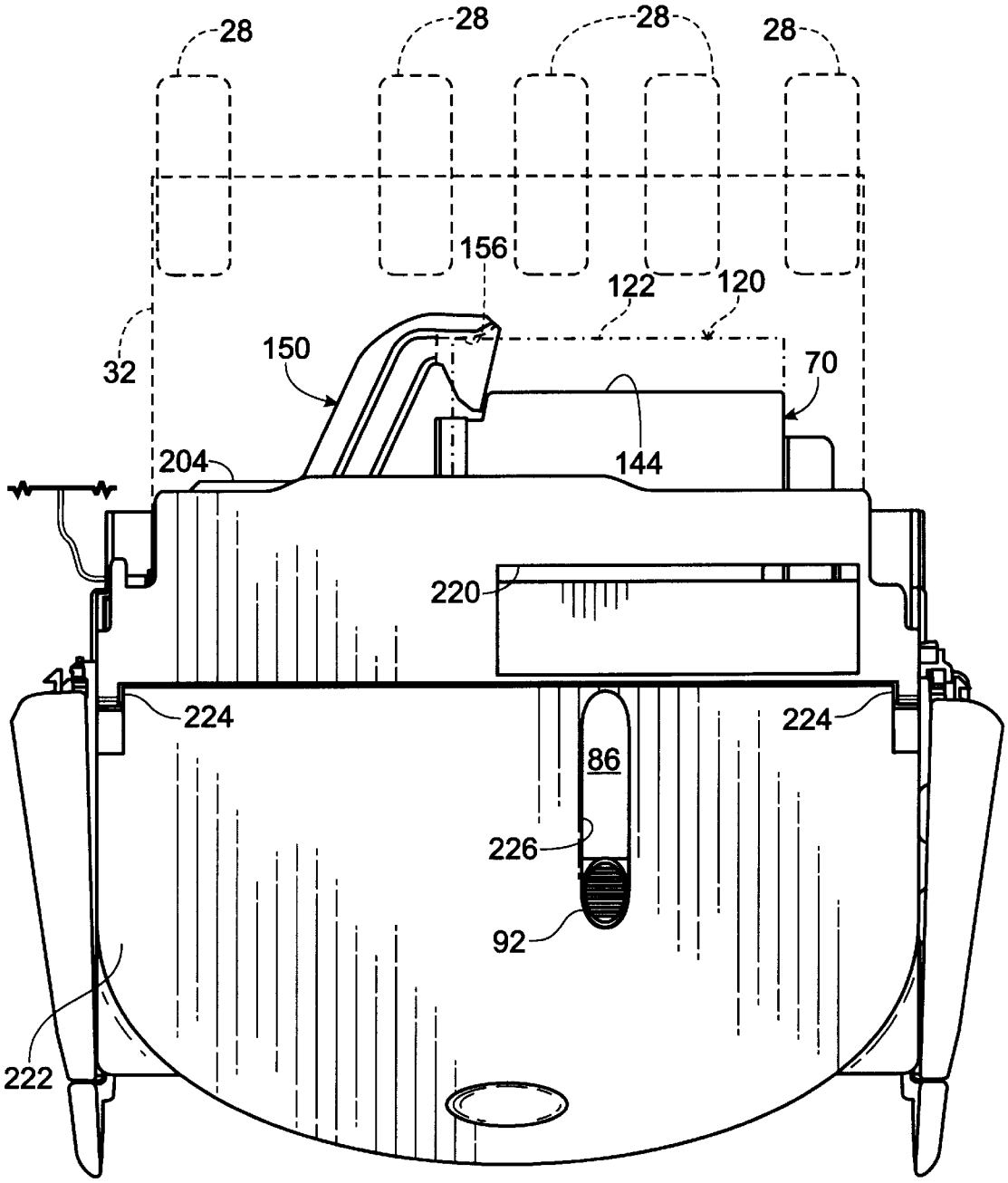
FIG. 8 is a top plan view, like FIG. 7, but also showing a hinged cover in place.

FIG. 8 shows the present media handling system with a movable cover 222 in place. That cover 222 is hinged as shown at 224 so that a user may move it from the closed position (FIG. 8) to expose the loading window 214 (see FIG. 7). In the closed position, nearly all of the outer end of the base 72 is covered except for an elongated slot 226 in which moves the exposed finger pad 92 as the tray is slid between the extended and retracted position. Thus, when the tray 70 is loaded with the media desired by the user, the user need not lift the cover 222 to move the tray into and out of the extended position.

Although a preferred embodiment of the system and its components have been described, it will be appreciated by one of ordinary skill that the spirit and scope of the invention is not limited to those embodiments, but extend to the various modifications and equivalents as defined in the appended claims. For example, the movement of the tray 70 into and out of the extended and retracted position may be carried out by actuators driven by the printer controller, thereby eliminating the need for the user to manipulate the tray.

Also, the tray could be embodied as a separate drawer or cartridge that is configured to be installed with the main supply drawer (thus using the same feed mechanism) in instances where, for example, one wished to employ a photo media cartridge that would be replaceable with another cartridge carrying other media, such as envelopes, index cards, etc.

What is claimed is:

1. A print media handling system for a printer, comprising:

a roller mounted to the printer and rotatable for advancing into the printer a sheet of print media that is moved into engagement with the roller;

a drawer for holding a sheet of first print media, the drawer having an inner end that resides adjacent to the roller;

a tray for holding a sheet of second print media, the tray being slidably mounted to the printer for moving a leading edge of the sheet of second print media into a pick zone that is between the roller and the inner end of the drawer; and a stop movably mounted in the printer and having a head that abuts the leading edge until the stop is moved out of such abutment by the sliding tray as the tray moves the leading edge into the pick zone.

2. The system of claim 1 wherein the tray is movable into a retracted position spaced from the pick zone, and wherein the stop is rotated by the movement of the tray into the retracted position so that the head moves into position for abutting a leading edge of another sheet of second print media that is placed in the tray.

3. The system of claim 1 wherein the tray is manually slidable into an extended position such that the leading edge of the sheet of second print media is in the pick zone and wherein the tray is sized so that a leading edge of the sheet of second print media protrudes from an edge of the tray.

4. The system of claim 1 wherein the tray includes a finger pad for facilitating manual sliding movement of the tray, the system further comprising a base mounted in the printer and supporting the sliding movement of the tray, and a cover mounted to the base and positionable for covering substantially all of the tray except for a slot in which the finger pad is exposed.

5. The system of claim 4 wherein the base is immovably mounted to the printer and spaced from the drawer to span across the drawer, thereby to permit both the drawer and the tray simultaneously to hold in the printer the sheet of first print media and the sheet of second print media, respectively.

6. The system of claim 1 wherein the stop is shaped to engage part of the tray to limit movement of the tray as the leading of the sheet of second print media moves into the pick zone.

7. The system of claim 1 wherein the stop is rotatably mounted to the printer and configured to contact the tray as the tray is slid to move the lading edge of the sheet of second print media into the pick zone, whereby the contact of the tray rotates the stop.

8. The system of claim 1 including a finger pad carried on the tray to facilitate manual sliding movement of the tray, the finger pad connecting with a latch member for releasably latching the tray in a retracted position wherein the leading edge of the sheet of second print media is out of the pick zone.

9. The system of claim 1 including a justification member mounted adjacent to the tray and urged into contact with the second sheet of print media to press that sheet against a side of the tray.

10. The system of claim 1 further comprising a generally planar base mounted to the printer and supporting the tray for sliding movement relative to the base, the tray also being supported for limited rotational movement relative to the base thereby to enable a leading edge of the tray to move beneath the plane of the base as the leading edge of the sheet of second print media is moved into the pick zone.

* * * * *